US010180015B1

(12) United States Patent
Grainger et al.

(10) Patent No.: US 10,180,015 B1
(45) Date of Patent: Jan. 15, 2019

(54) TILT LATCH RETAINER APPARATUS AND SASHES INCORPORATING SAME

(71) Applicant: ANDERSEN CORPORATION, Bayport, MN (US)

(72) Inventors: Sean Grainger, Woodbury, MN (US); Craig Johnson, North Oaks, MN (US)

(73) Assignee: ANDERSEN CORPORATION, Bayport, MN (US)

( * ) Notice: Subject to any disclaimer, the term of this patent is extended or adjusted under 35 U.S.C. 154(b) by 150 days.

(21) Appl. No.: 15/420,277

(22) Filed: Jan. 31, 2017

Related U.S. Application Data

(60) Provisional application No. 62/290,074, filed on Feb. 2, 2016.

(51) Int. Cl.

| | |
|---|---|
| ***E05B 65/06*** | (2006.01) |
| ***E05C 7/00*** | (2006.01) |
| ***E05C 9/04*** | (2006.01) |
| ***E05D 15/22*** | (2006.01) |
| ***E05B 65/08*** | (2006.01) |
| ***E05B 9/02*** | (2006.01) |

(52) U.S. Cl.
CPC ..... *E05B 65/06* (2013.01); *E05B 9/02* (2013.01); *E05B 65/0864* (2013.01); *E05C 7/00* (2013.01); *E05C 9/04* (2013.01); *E05D 15/22* (2013.01); *E05C 2007/007* (2013.01)

(58) Field of Classification Search
CPC ..... E05B 5/003; E05B 5/00; E05B 65/0888; E05B 63/06; E05B 65/0085; E05C 9/10; E05C 9/021; E05C 1/14; E05C 3/046; E05C 2007/007; E05C 7/04; Y10S 292/20; Y10S 292/47
USPC ..... 49/394, 183, 184, 301, 185, 395, 449; 292/24, 25, 44, 45, 48, 195, 200, 203, 292/DIG. 20, DIG. 35
See application file for complete search history.

(56) References Cited

U.S. PATENT DOCUMENTS

| | | | | |
|---|---|---|---|---|
| 3,324,597 | A * | 6/1967 | Rich | E06B 3/4618 160/90 |
| 3,927,492 | A * | 12/1975 | Carson | B60J 1/10 49/141 |
| 4,151,682 | A * | 5/1979 | Schmidt | E06B 3/26347 49/404 |
| 4,791,756 | A | 12/1988 | Simpson | |
| 5,585,155 | A | 12/1996 | Heikkila et al. | |
| 6,041,552 | A * | 3/2000 | Lindahl | E05D 15/06 49/458 |
| 6,106,944 | A | 8/2000 | Heikkila et al. | |
| 6,183,024 | B1 | 2/2001 | Schultz et al. | |
| 6,210,792 | B1 | 4/2001 | Seethamraju et al. | |
| 6,260,251 | B1 | 7/2001 | Guhl | |

(Continued)

*Primary Examiner* — Chi Q Nguyen
(74) *Attorney, Agent, or Firm* — Mueting, Raasch & Gebhardt, P.A.

(57) ABSTRACT

The tilt latch retainer apparatus and sashes incorporating the same described herein may provide a convenient construction for both initial insertion of a tilt latch assembly into a sash and/or for replacement of a tilt latch assembly in an existing sash. The tilt latch retainer apparatus and sashes incorporating the same may also provide reinforcement of the check rail on a sash including the tilt latch retainer apparatus such that the check rail including the tilt latch retainer apparatus is more resistant to mechanical deformation due to forces exerted on the check rail.

28 Claims, 9 Drawing Sheets

(56) References Cited

U.S. PATENT DOCUMENTS

| | | | | |
|---|---|---|---|---|
| 6,280,667 | B1 | 8/2001 | Koenig et al. | |
| 6,342,172 | B1 | 1/2002 | Finley | |
| 6,877,784 | B2 | 4/2005 | Kelley et al. | |
| 7,013,603 | B2 | 3/2006 | Eenigenburg et al. | |
| 7,065,929 | B2 * | 6/2006 | Manzella | E06B 3/26347 52/204.1 |
| 7,070,211 | B2 | 7/2006 | Polowinczak et al. | |
| 7,070,215 | B2 | 7/2006 | Kelley et al. | |
| 7,322,619 | B2 | 1/2008 | Nolte et al. | |
| 7,607,262 | B2 | 10/2009 | Pettit et al. | |
| 7,827,734 | B2 * | 11/2010 | Cox | E06B 5/12 49/125 |
| 7,882,657 | B2 | 2/2011 | Duncan et al. | |
| 8,132,369 | B2 | 4/2012 | Pettit et al. | |
| 8,550,507 | B2 * | 10/2013 | Barton | E05B 63/20 292/194 |
| 2011/0192089 | A1 * | 8/2011 | Barton | E05B 63/20 49/394 |

* cited by examiner

TILT LATCH RETAINER APPARATUS AND SASHES INCORPORATING SAME

RELATED APPLICATION

This application claims the benefit under 35 U.S.C. § 119 of U.S. Provisional Application Ser. No. 62/290,074 filed Feb. 2, 2016, entitled TILT LATCH RETAINER APPARATUS AND SASHES INCORPORATING SAME, which is incorporated herein by reference in its entirety.

Tilt latch retainer apparatus and sashes incorporating the tilt latch retainer apparatus are described herein along with methods of using the same.

Fenestration units incorporating one or more movable sashes supported within a frame are well known. In some constructions, the sash and fenestration unit may be constructed to allow the sash to be tilted inward for, e.g., cleaning or other maintenance issues. To allow for tilting, the sash may be pivotally mounted in a frame, with the sash including one or more tilt latches installed in the sash. The tilt latches typically have a latch bolt biased outwardly to engage a portion of the frame in which the sash is located. Movement of the latch bolts inwardly to retract them allows for disengagement and tilting of the sash for, as described herein, cleaning or other maintenance purposes.

As used herein, the term "fenestration unit" may include windows or doors having one or more sliding sashes. The sliding sash may move vertically or horizontally within the frame of the fenestration unit. Non-limiting examples of fenestration units may include, e.g., double hung windows including a sash which moves vertically, sliding windows including a sash which moves horizontally, patio doors including a sash which moves horizontally, etc.

SUMMARY

The tilt latch retainer apparatus and sashes incorporating the same described herein may provide a convenient construction for both initial insertion of a tilt latch assembly into a sash and/or for replacement of a tilt latch assembly in an existing sash.

In one or more embodiments, the tilt latch retainer apparatus described herein may be inserted into an existing channel formed in a sash by, e.g., sliding the tilt latch retainer apparatus into a channel from one end of the channel, inserting the tilt latch retainer apparatus into the top of a channel (in a direction transverse to the length of the channel), etc. As a result, initial insertion of the tilt latch retainer apparatus into the sash during manufacturing may be simplified. Further, replacement of a malfunctioning tilt latch in one or more embodiments of the tilt latch retainer apparatus described herein may be simplified by allowing for easy removal and replacement of the tilt latch retainer apparatus as an assembly. Alternatively, the tilt latch retainer apparatus may be easily removed from a sash to allow for replacement of the malfunctioning parts. The repaired tilt latch retainer apparatus may then be reinserted into the sash.

In one or more embodiments, the tilt latch retainer apparatus and sashes incorporating the same as described herein may also provide reinforcement of the check rail on a sash including the tilt latch retainer apparatus such that the check rail including the tilt latch retainer apparatus is more resistant to mechanical deformation due to forces exerted on the check rail.

In a first aspect, one or more embodiments of a tilt latch retainer apparatus for a check rail of a sash as described herein may include: a reinforcement member comprising an inner leg and a mating surface leg, wherein the inner leg and the mating surface leg are connected to each other by a top beam such that the inner leg, the mating surface leg, and the top beam form a generally U-shaped reinforcement member extending from a first end of the reinforcement member to a second end of the reinforcement member along a reinforcement channel axis that extends through a reinforcement channel formed by the inner leg, the mating surface leg and the top beam, wherein the inner leg and the mating surface leg define a reinforcement channel width measured between the inner leg and the mating surface leg in a direction transverse to the channel axis, and further wherein the mating surface leg comprises a bearing surface facing the inner leg, wherein the bearing surface is configured to bear against a mating surface of a sash member on which the reinforcement member is located when the reinforcement member is installed on a check rail of a sash; an interlocking flange located on the mating surface leg distal from the top beam, wherein the interlocking flange is oriented relative to the bearing surface such that the interlocking flange is configured to define a flange gap between interlocking flange and the mating surface of the sash member against which the bearing surface bears when the reinforcement member is installed on a check rail of a sash; and a first tilt latch assembly attached to the inner leg proximate the first end of the reinforcement member and a second tilt latch assembly attached to the inner leg of the proximate the second end of the reinforcement member, wherein the reinforcement member maintains a selected distance between the first tilt latch assembly and the second tilt latch assembly along the reinforcement channel axis.

In one or more embodiments of a tilt latch retainer apparatus as described herein, the flange gap comprises a depth measured from a free edge of the interlocking flange towards the top beam of the reinforcement member that is greater than a width of the flange gap measured transverse to the depth of the of the flange gap. In one or more embodiments, the depth of the flange gap remains constant from a first end of the reinforcement member to the second end of the reinforcement member, and wherein the width of the flange gap remains constant from a first end of the reinforcement member to the second end of the reinforcement member.

In one or more embodiments of a tilt latch retainer apparatus as described herein, the apparatus further comprises a bottom beam and an innermost leg, wherein the inner leg of the reinforcement member and the innermost leg are attached to each other by the bottom beam to form a generally U-shaped tilt latch retainer channel, wherein the tilt latch retainer channel defines a tilt latch channel axis aligned with the reinforcement channel axis, and wherein the tilt latch channel extends from the first end of the reinforcement member to the second end of the reinforcement member, and further wherein the first tilt latch assembly and the second tilt latch assembly are located between the inner leg and the innermost leg in the tilt latch retainer channel. In one or more embodiments, the reinforcement channel and the tilt latch retainer channel open in opposite directions. In one or more embodiments, the mating surface leg, top beam, inner leg, bottom beam and innermost leg of the reinforcement member and the tilt latch retainer channel comprise a one piece, completely integral article.

In one or more embodiments of a tilt latch retainer apparatus as described herein, the first tilt latch assembly comprises a first latch bolt movable between an engagement position and a retracted position, wherein the first latch bolt extends past the first end of the reinforcement channel when in the engagement position, and wherein the second tilt latch assembly comprises a second latch bolt movable between an engagement position and a retracted position, wherein the second latch bolt extends past the second end of the reinforcement channel when in the engagement position. In one or more embodiments, the apparatus further comprises a common tilt latch actuator operably connected to both the first tilt latch assembly and the second tilt latch assembly, wherein the common tilt latch actuator is configured to move the first latch bolt and the second latch bolt from their respective engagement positions to their respective retracted positions. In one or more embodiments, the tilt latch actuator extends in a direction aligned with the reinforcement channel axis.

In one or more embodiments of the tilt latch retainer apparatus described herein including first and second tilt latch assemblies, the first tilt latch assembly comprises a first actuator operably connected to the first latch bolt, wherein the first tilt latch actuator is configured to move the first latch bolt from its engagement position to its retracted position, and wherein the second tilt latch assembly comprises a second actuator operably connected to the second latch bolt, wherein the second tilt latch actuator is configured to move the second latch bolt from its engagement position to its retracted position.

In a second aspect, one or more embodiments of a sash apparatus as described herein may include: a sash comprising a frame that comprises a check rail located along one edge of the sash, wherein the check rail comprises a mating surface and a non-mating surface facing away from the mating surface, wherein the check rail receives one edge of a panel contained in the frame of the sash such that the one edge is positioned between the mating surface and the non-mating surface; a tilt latch channel located in the check rail between the mating surface and the non-mating surface, wherein the tilt latch channel extends along a check rail axis extending between a first end of the check rail and a second end of the check rail, wherein the tilt latch channel occupies only a portion of a width of the check rail as measured between the mating surface and the non-mating surface; a tilt latch retainer apparatus located in the tilt latch channel of the check rail, wherein the tilt latch retainer apparatus comprises a mating surface leg and a top beam attached to the mating surface leg, wherein the mating surface leg is positioned on the mating surface of the check rail and wherein the top beam spans a portion of the width of the check rail from the mating surface to the tilt latch channel. In one or more embodiments, the tilt latch retainer apparatus comprises: an interlocking flange on the mating surface leg, wherein the interlocking flange is positioned on the mating surface of the check rail and is aligned with the check rail axis, and wherein the interlocking flange defines a flange gap between interlocking flange and the mating surface of the check rail; a first tilt latch assembly operably attached to the top beam of the tilt latch retainer apparatus such that the first tilt latch assembly is positioned in the tilt latch channel of the check rail proximate the first end of the check rail; and a second tilt latch assembly operably attached to the top beam of the tilt latch retainer apparatus such that the second tilt latch assembly is positioned in the tilt latch channel of the check rail proximate the second end of the check rail. In one or more embodiments, the tilt latch retainer apparatus maintains a selected distance between the first tilt latch assembly and the second tilt latch assembly along the tilt latch channel.

In one or more embodiments of the sash apparatus including a tilt latch retainer apparatus as described herein, the top beam extends along a length of the check rail between the first tilt latch assembly and the second tilt latch assembly.

In one or more embodiments of the sash apparatus including a tilt latch retainer apparatus as described herein, the mating surface leg and the top beam form an inside corner positioned over an outside corner of the check rail.

In one or more embodiments of the sash apparatus including a tilt latch retainer apparatus as described herein, the tilt latch channel is enclosed within the check rail except for a first opening at the first end of the check rail and a second opening at the second end of the check rail.

In one or more embodiments of the sash apparatus including a tilt latch retainer apparatus as described herein, the tilt latch retainer apparatus comprises an inner leg connected to the top beam and positioned in the tilt latch channel of the check rail such that a reinforced portion of the check rail is located between the mating surface leg and the inner leg, and wherein a first section of the inner leg is located between the first tilt latch assembly and the reinforced portion of the check rail, and further wherein a second section of the inner leg is located between the reinforced portion of check rail and the second tilt latch assembly. In one or more embodiments, the inner leg extends through the tilt latch channel from the first tilt latch assembly to the second tilt latch assembly. In one or more embodiments, the mating surface leg, the top beam, and the inner leg form a generally U-shaped reinforcement member containing the reinforced portion of the check rail.

In one or more embodiments of the sash apparatus including a tilt latch retainer apparatus as described herein, the flange gap comprises a depth measured from a free edge of the interlocking flange towards the top beam that is greater than a width of the flange gap measured between the free edge of the interlocking flange and the mating surface of the check rail. In one or more embodiments, the depth of the flange gap remains constant over a length of the interlocking flange, where the length is measured in a direction aligned with the check rail axis. In one or more embodiments, the width of the flange gap remains constant over the length of the interlocking flange.

In one or more embodiments of the sash apparatus including a tilt latch retainer apparatus as described herein, the tilt latch retainer apparatus further comprises a bottom beam and an innermost leg, wherein the inner leg and the innermost leg are attached to each other by the bottom beam to form a generally U-shaped tilt latch retainer channel, wherein the tilt latch retainer channel defines a tilt latch channel axis aligned with the check rail axis. In one or more embodiments, the tilt latch retainer channel extends from the first end of the check rail to the second end of the check rail. In one or more embodiments, the mating surface leg, top beam, inner leg, bottom beam and innermost leg comprise a one piece, completely integral article.

In one or more embodiments of the sash apparatus including a tilt latch retainer apparatus as described herein, the first tilt latch assembly comprises a first latch bolt movable between an engagement position and a retracted position, wherein the first latch bolt extends past the first end of the check rail when in the engagement position, and wherein the second tilt latch assembly comprises a second latch bolt movable between an engagement position and a retracted position, wherein the second latch bolt extends past the second end of the check rail when in the engagement position. In one or more embodiments, the tilt latch retainer apparatus includes a common tilt latch actuator operably connected to both the first tilt latch assembly and the second tilt latch assembly, wherein the common tilt latch actuator is configured to move the first latch bolt and the second latch bolt from their respective engagement positions to their respective retracted positions. In one or more embodiments, the tilt latch actuator extends in a direction aligned with the check rail axis.

In one or more embodiments including first and second tilt latch assemblies, the tilt latch retainer assembly comprises a first actuator operably connected to the first latch bolt, wherein the first tilt latch actuator is configured to move the first latch bolt from its engagement position to its retracted position, and wherein the second tilt latch assembly comprises a second actuator operably connected to the second latch bolt, wherein the second tilt latch actuator is configured to move the second latch bolt from its engagement position to its retracted position.

In one or more embodiments of the sash apparatus including a tilt latch retainer apparatus as described herein, the sash comprises a window sash and the panel comprises a glazing panel. In one or more embodiments, the window sash comprises a movable window sash located in a window frame containing another window sash, wherein the movable window sash is movable between an open position and a closed position in the window frame. In one or more embodiments, the movable window sash comprises a lower sash of a double hung window unit.

In a third aspect, one or more embodiments of a method of installing tilt latches in a check rail of a sash as described herein may include: inserting a tilt latch retainer apparatus into a tilt latch channel in a check rail, wherein the tilt latch channel is positioned between a mating surface and a non-mating surface of the check rail and extends along a check rail axis from a first end of the check rail to a second end of the check rail. In one or more embodiments, the tilt latch retainer apparatus comprises: a mating surface leg and a top beam attached to the mating surface leg; an interlocking flange on the mating surface leg; a first tilt latch assembly operably attached to the top beam of the tilt latch retainer apparatus; and a second tilt latch assembly operably attached to the top beam of the tilt latch retainer apparatus. The method may further include aligning the tilt latch retainer apparatus in the tilt latch channel such that the first tilt latch assembly is positioned in the tilt latch channel of the check rail proximate the first end of the check rail and, at the same time, the second tilt latch assembly is positioned in the tilt latch channel of the check rail proximate the second end of the check rail. In one or more embodiments, the tilt latch retainer apparatus maintains a selected distance between the first tilt latch assembly and the second tilt latch assembly along the tilt latch channel; the mating surface leg is positioned on a mating surface of the check rail and wherein the top beam spans a portion of a width of the check rail from the mating surface to the tilt latch channel; and the interlocking flange is positioned on the mating surface of the check rail and is aligned with the check rail axis, and wherein the interlocking flange defines a flange gap between interlocking flange and the mating surface of the check rail. In one or more embodiments, the method may further include securing the tilt latch retainer apparatus in the tilt latch channel after inserting and aligning the tilt latch retainer apparatus in the tilt latch channel.

In one or more embodiments of the methods described herein, inserting the tilt latch retainer apparatus comprises sliding the tilt latch retainer apparatus into the tilt latch channel in the check rail in a direction aligned with the check rail axis.

In one or more embodiments of the methods described herein, inserting the tilt latch retainer apparatus comprises moving the tilt latch retainer apparatus into the tilt latch channel in the check rail in a direction transverse to the check rail axis. In one or more embodiments, the method further comprises attaching a check rail cover over the tilt latch retainer in the tilt latch channel after inserting the tilt latch retainer apparatus into the tilt latch channel.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Where used herein, the terms "top" and "bottom" are used for reference relative to each other only and, depending on the orientation of the tilt latch retainer apparatus and sashes when used, may or may not accurately describe the relative positions of the recited features with respect to the ground.

The above summary is not intended to describe each embodiment or every implementation of the tilt latch retainer apparatus and sashes and methods of using the same as described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
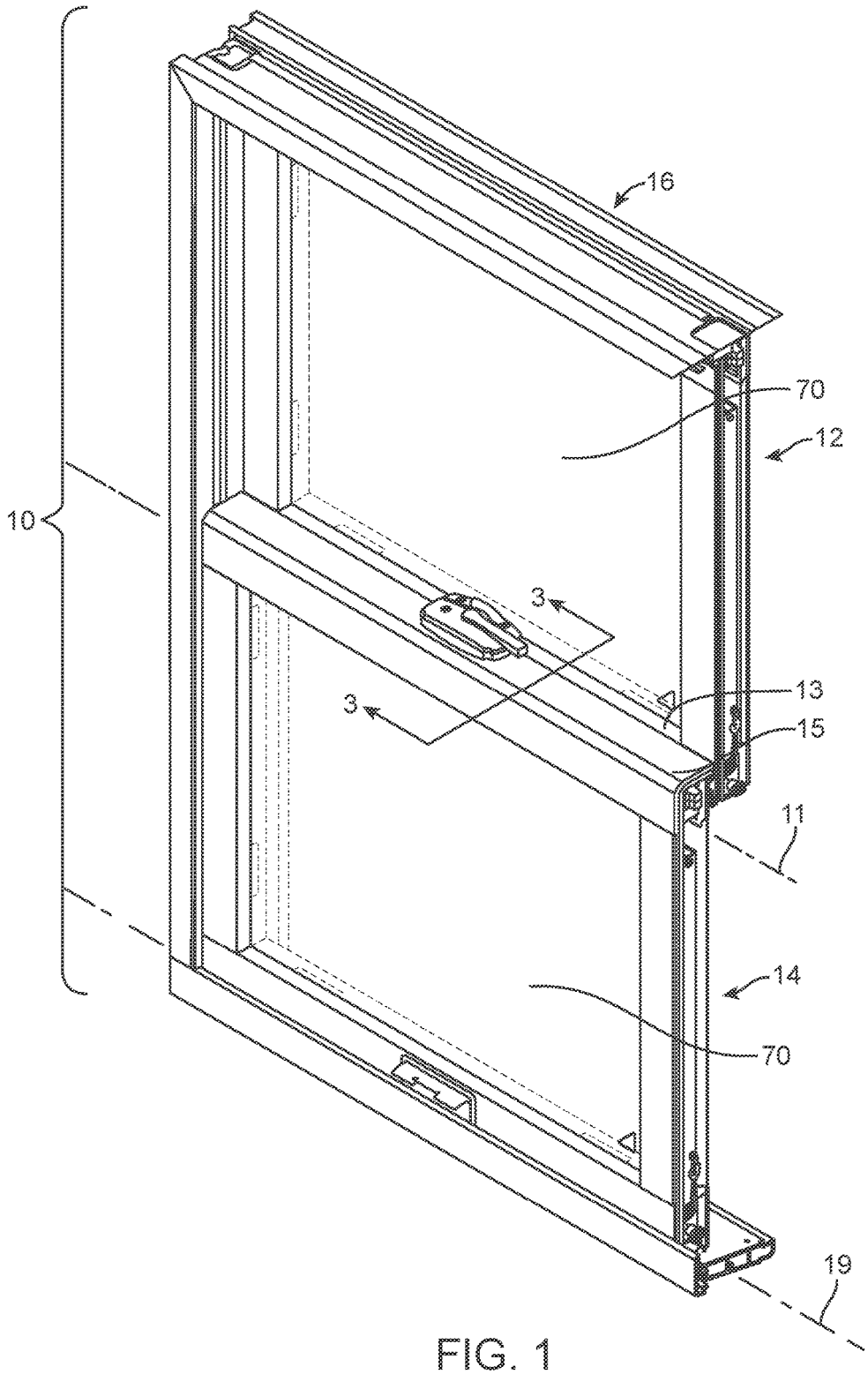
FIG. 1 is a perspective view of one illustrative embodiment of a fenestration unit in the form of a double hung window in which the tilt latch retainer apparatus and sashes described herein may be used.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

The tilt latch retainer apparatus and sashes incorporating the same described herein may provide a convenient construction for both initial insertion of a tilt latch assembly into a sash and/or for replacement of a tilt latch assembly in an existing sash. In one or more embodiments, the tilt latch retainer apparatus and sashes incorporating the same as described herein may also provide reinforcement of the check rail on a sash including the tilt latch retainer apparatus such that the check rail including the tilt latch retainer apparatus is more resistant to mechanical deformation due to forces exerted on the check rail.

Figure 2:
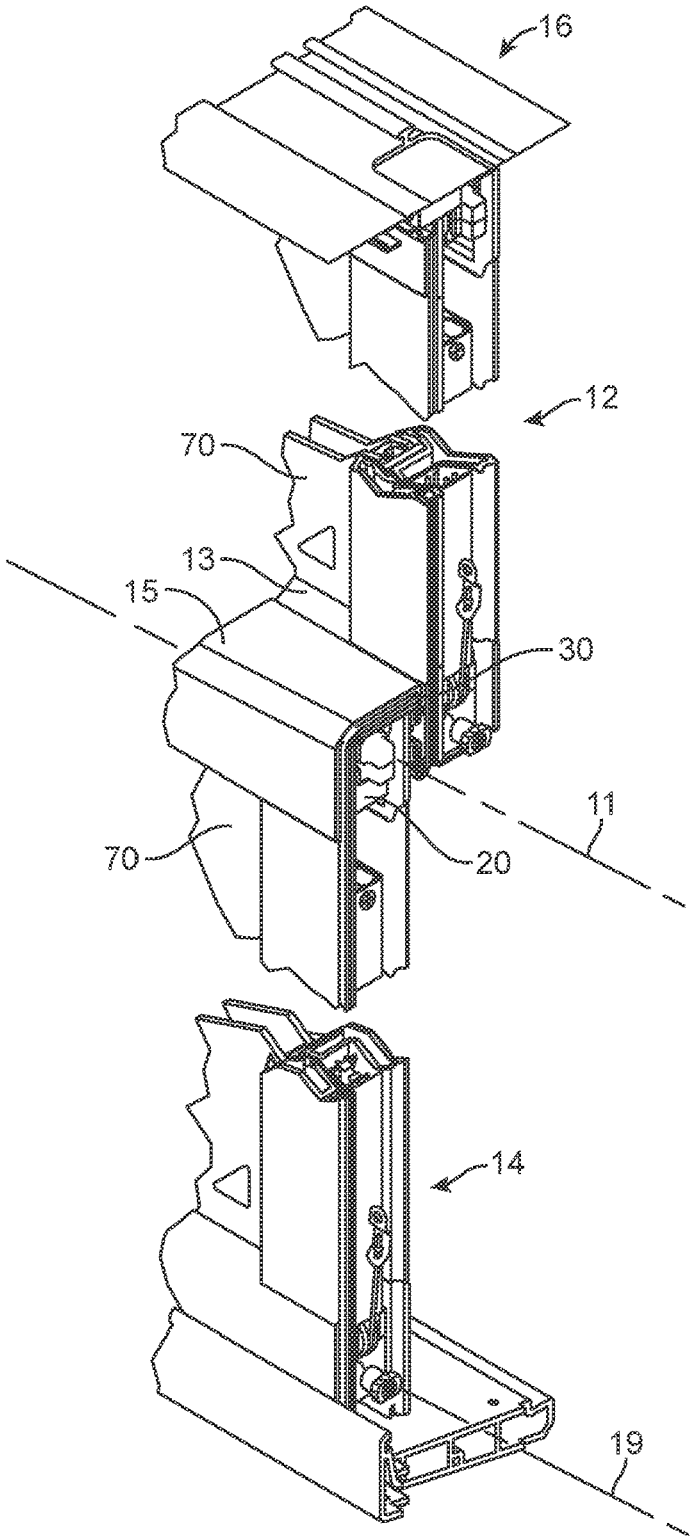
FIG. 2 is an enlarged view of the junction between the check rails of the upper and lower sashes of the double hung window of FIG. 1.

One illustrative embodiment of a fenestration unit in the form of a double hung window 10 including an upper sash 12 containing a glazing panel 70 and a lower sash 14 containing a glazing panel 70 is depicted in FIGS. 1 and 2. The upper and lower sashes 12 and 14 are contained within a frame 16, with one of the frame members removed to expose the junction between check rails on both the upper and lower sashes 12 and 14 of the window 10. In particular, upper sash 12 with its check rail 13 is depicted along with lower sash 14 and its check rail 15. Although the depicted fenestration unit in the form of window 10 includes a rectangular frame 16 along with rectangular sashes 12 and 14, frames and/or sashes located in fenestration units incorporating the tilt latch retainer apparatus described herein may take other shapes in one or more alternative embodiments.

Check rails are the members of sash frames that are positioned and designed to meet when a fenestration unit such as double hung window 10 is closed. In particular, check rails typically include one or more structures used to seal the junction between sashes. They may also, in one or more embodiments, carry locking mechanisms to prevent unwanted opening of the fenestration unit.

In the depicted embodiment, check rail 15 of lower sash 14 defines a check rail axis 11 that is horizontal in orientation when the window 10 is installed in an opening. Although the check rails 13 and 15, along with check rail axis 11, are horizontal in a double hung window, the sashes and check rails (or corresponding structural components) incorporating a tilt latch retainer apparatus as described herein in other fenestration units such as, e.g., sliding windows, patio doors, etc. may be positioned in other orientations such as, e.g., vertical. For example, a tilt latch retainer apparatus as described herein may be included in a door panel (i.e., the structural equivalent of a window sash) and, furthermore, the tilt latch retainer apparatus as described herein may be included in a rail or a stile of a door panel or window sash. As a result, although described as being located in a check rail, the tilt latch retainer apparatus described herein may actually be located in what is more commonly referred to as a stile (i.e., a vertically oriented member). Further, although described as being located in a sash, the tilt latch retainer apparatus described herein action be located in a door panel.

Furthermore, although the illustrative embodiment of double hung window 10 includes glazing panels 70 in sashes 12 and 14, it should be understood that in other embodiments of fenestration units incorporating the tilt latch retainer apparatus described herein, the panels in one or more of the sashes may or may not be glazing panels. For example, in one or more embodiments, a panel in a sash of a fenestration unit incorporating a tilt latch retainer apparatus as described herein may be a solid panel constructed of wood or other materials.

Figure 1A:
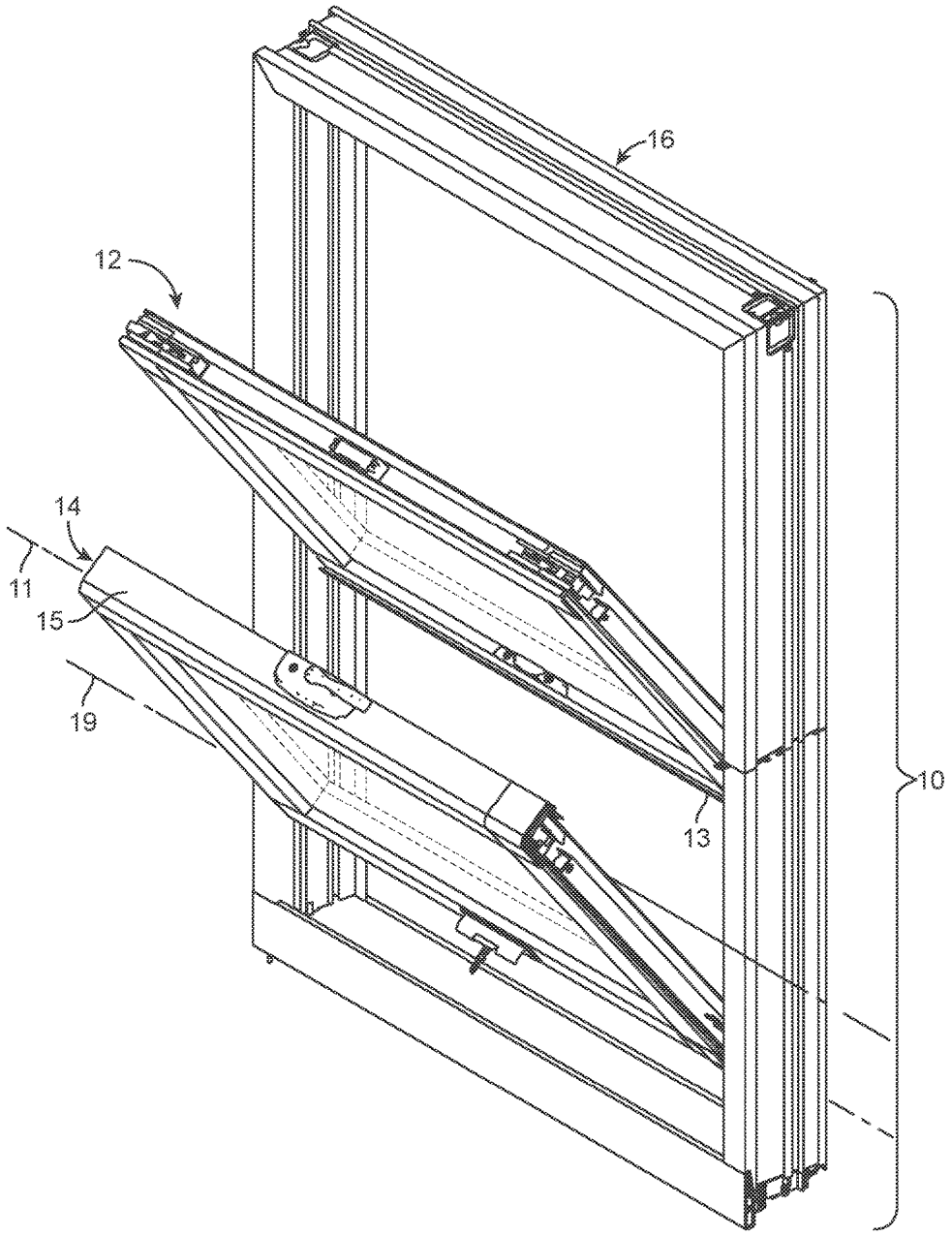
FIG. 1A is a perspective view of the illustrative embodiment of the fenestration unit of FIG. 1 with the upper and lower sashes tilted outward.

In the depicted embodiment of window 10, the lower sash 14 is pivotally mounted in the frame 16 for rotation about a tilt axis 19 that extends through the lower rail of the lower sash 14. Also in the depicted embodiment of window 10, the lower sash 14 includes tilt latches 20 located in the tilt latch retainer apparatus 30 at opposite ends of the check rail 15, although only one tilt latch 20 is seen in the views depicted in FIGS. 1 and 2. The lower sash 14 is depicted as pivotally rotated about tilt axis 19 in FIG. 1A after release of the tilt latch assemblies in the tilt latch retainer apparatus 30.

Figure 3:
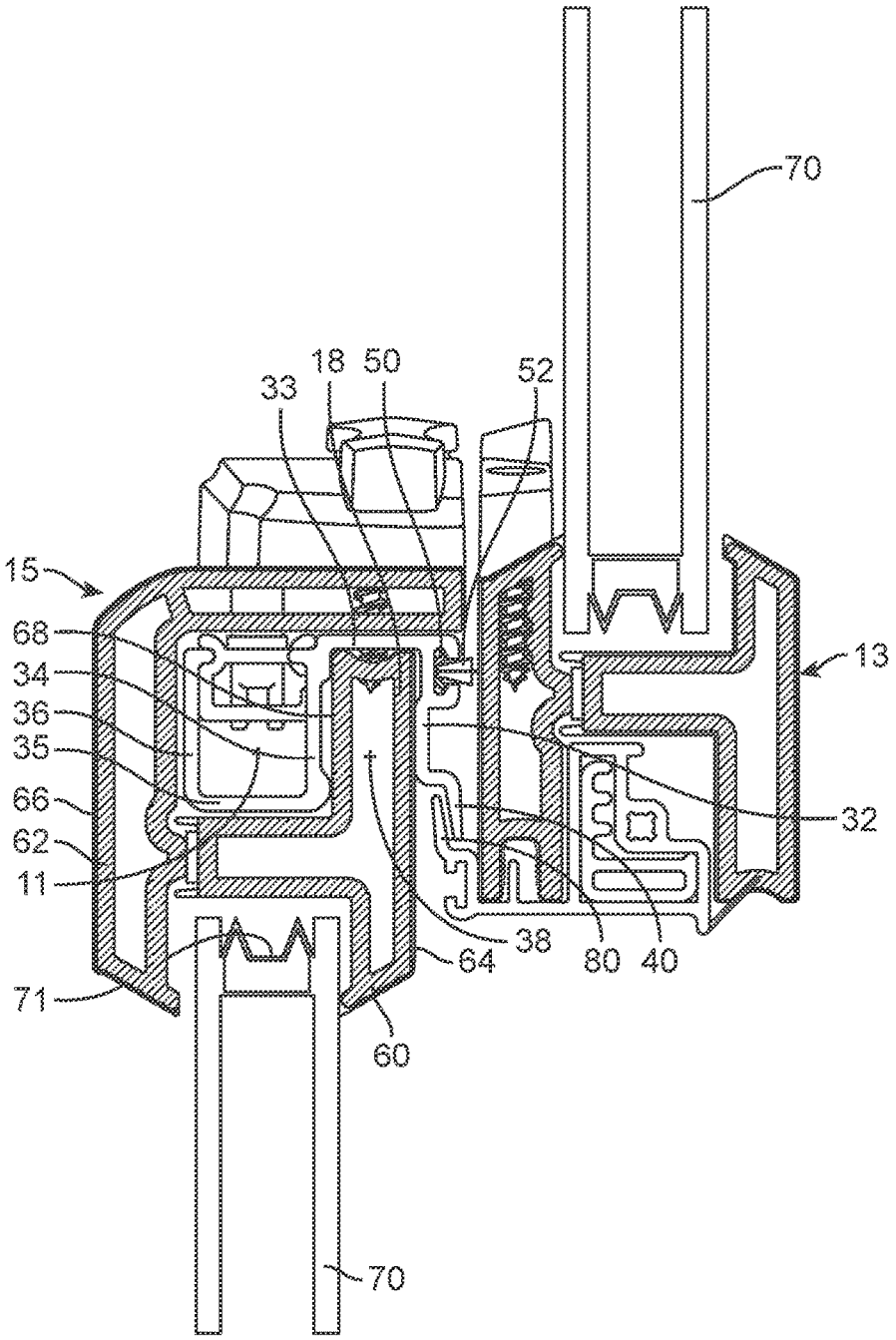
FIG. 3 is an enlarged cross-sectional view of the check rail junction depicted in FIGS. 1 and 2 taken along line 3-3 in FIG. 1 depicting one illustrative embodiment of a tilt latch retainer apparatus located therein.

An enlarged cross-sectional view of the junction between check rails 13 and 15 of the upper and lower sashes 12 and 14, respectively, is provided in FIG. 3. In particular, the check rail 15 is formed of frame components 60 and 62 which, when combined together, form the check rail 15. In one or more alternative embodiments, the check rail 15 may, however, be a single unitary frame component with appropriate cavities and channels formed therein. The frame components 60 and 62 may be made of any suitable material or combination of materials, wood, metal, polymers, fiberglass, etc. In one or more embodiments, the frame components 60 and 62 may be manufactured of an extruded material which may include fibers and a polymer, pultruded materials, etc. Examples of some potentially suitable constructions for frame components that may be used to construct sashes as described herein may include those described in, e.g., U.S. Pat. No. 5,585,155 (Heikkila et al.); U.S. Pat. No. 6,106,944 (Heikkila et al.); U.S. Pat. No. 6,210,792 Seethamraju et al.); U.S. Pat. No. 6,260,251 (Guhl); U.S. Pat. No. 6,280,667 (Koenig et al.); U.S. Pat. No. 6,342,172 (Finley); etc.

The check rail 15 includes a channel into which one edge 71 of a glazing panel 70 may be received. The check rail 15 also includes a mating surface 64 and a non-mating surface 66 located on an opposite side of the check rail 15. In particular, the mating surface 64 faces the check rail 13 of the upper sash 12 while the non-mating surface 66 faces away from the check rail 13 of the upper sash 12. In one or more embodiments, the edge 71 of the glazing panel 70 is located between the mating surface 64 and the non-mating surface 66.

One illustrative embodiment of a tilt latch retainer apparatus 30 is depicted within a tilt latch channel 68. The tilt latch channel 68 is located in the check rail 15 between the mating surface 64 and the non-mating surface 66. In one or more embodiments, the tilt latch channel 68 extends along a check rail axis 11 that extends between the ends of the check rail 15 (e.g., the first and second ends of the check rail 15). The tilt latch channel 68 may, in one or more embodiments, occupy only a portion of a width of the check rail 15, where the width of the check rail 15 is measured between the mating surface 64 and the non-mating surface 66.

Figure 4:
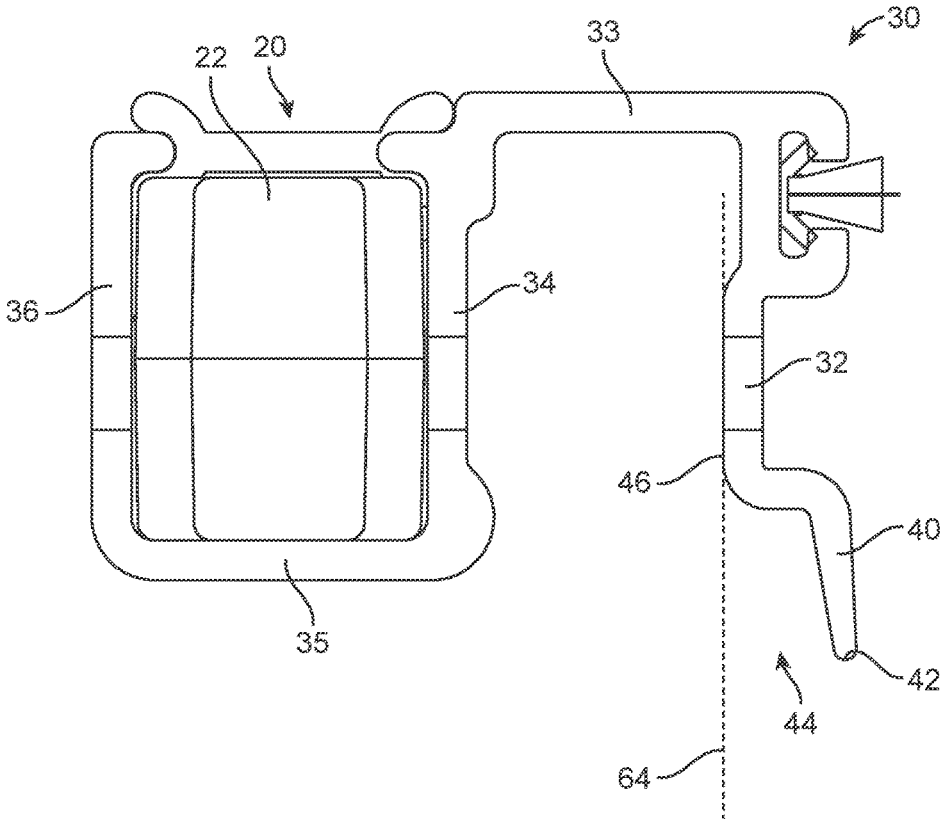
FIG. 4 is an enlarged cross-sectional view of the illustrative embodiment of a tilt latch retainer apparatus depicted in FIG. 3 removed from the check rail.
Figure 5:
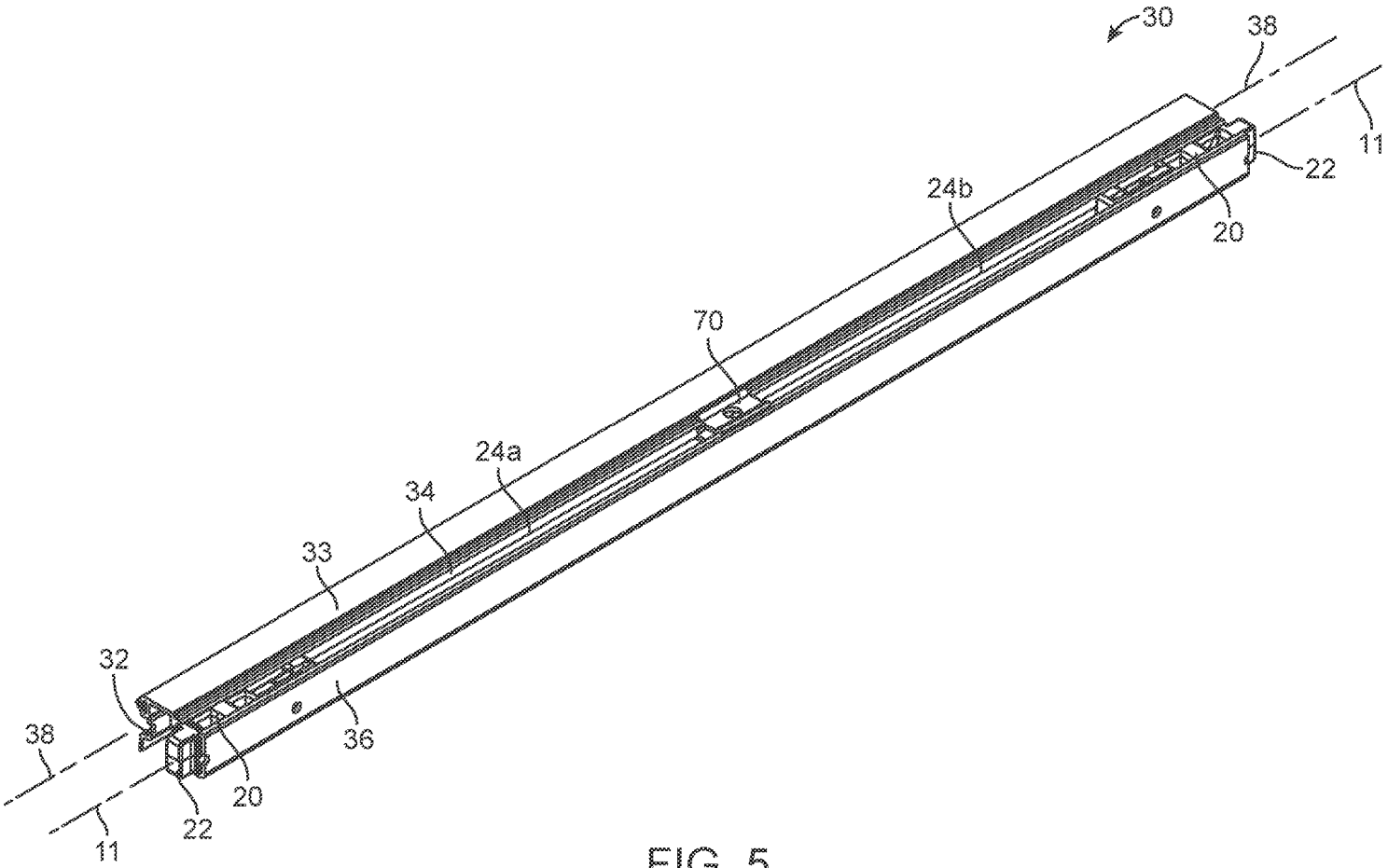
FIG. 5 is a perspective view the illustrative embodiment of the tilt latch retainer apparatus of FIGS. 1-4 removed from a sash.
Figure 6:
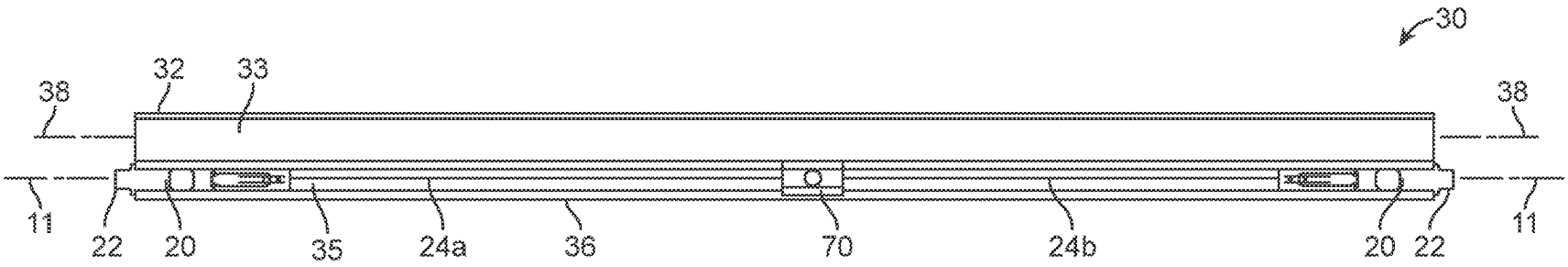
FIG. 6 is a top plan view the illustrative embodiment of the tilt latch retainer apparatus of FIG. 5.

The illustrative embodiment of tilt latch retainer apparatus 30, depicted in FIG. 3 in its installed location within check rail 15, is depicted removed from the check rail 15 in FIGS. 4 to 6. Referring to FIGS. 3 to 6, the illustrative embodiment of tilt latch retainer apparatus 30 includes a mating surface leg 32 and a top beam 33 attached to the mating surface leg 32. In the depicted illustrative embodiment, the mating surface leg 32 is positioned on the mating surface 64 of the check rail 15, with the top beam 33 spanning a portion of the width of the check rail 15 from the mating surface 64 to the tilt latch channel 68. In one or more embodiments, the mating surface leg 32 and the top beam 33 of the tilt latch retainer apparatus 30 may be positioned generally perpendicular to each other to form an inside corner positioned over an outside corner of the check rail 15. Such a relative orientation between the mating surface leg 32 and the top beam 33 may improve the structural rigidity of at least that portion of the tilt latch retainer apparatus 30. In the depicted illustrative embodiment, the outside corner of the check rail 15 is formed at the upper edge of the mating surface 64 of the check rail 15.

In one or more embodiments, the tilt latch retainer apparatus includes an interlocking flange 40 on the mating surface leg 32. The interlocking flange 40 is positioned over the mating surface 64 of the check rail 15. In one or more embodiments, the interlocking flange 40 is aligned with the check rail axis 11. The interlocking flange 40 may, in one or more embodiments, define a flange gap 44 (see, e.g., FIG. 4) between the interlocking flange 40 and the mating surface 64 of the check rail 15. In one or more embodiments, the flange gap 44 may have a depth measured from a free edge 42 of the interlocking flange 40 towards the top beam 33 (i.e., in a direction generally transverse to the check rail axis 11) that is greater than a width of the flange gap 44 where the width of the flange gap 44 is measured between the free edge 42 of the interlocking flange 40 and the mating surface 64 of the check rail 15. In one or more embodiments, the depth of the flange gap 44 may remain constant over a length of the interlocking flange 40 (where the length is measured in a direction aligned with the check rail axis 11).

The interlocking flange 40 on the mating surface leg 32 may, in one or more embodiments, be configured to interlock with an interlocking flange 80 located on the check rail 13 positioned across from the mating surface 64 of check rail 15 as best seen in, e.g., FIG. 3. Referring to, e.g., FIG. 4, the mating surface leg 32 may also include a weatherstripping channel 50 configured to retain a seal or weatherstripping 52 positioned to contact with an seal against a mating surface of the check rail 13. Although not depicted in, e.g., FIG. 3, the interlocking flange 80 on check rail 13 may also include a weatherstripping channel 82 that may also be configured to retain a weatherstripping seal that acts against or on mating surface 64 of check rail 15. As a result, the check rails 13 and 15 may be interlocked with each other by flanges 40 and 80 two improve structural rigidity of the window 10 when sashes 12 and 14 are closed.

Further, the interlocking flanges 40 and 80 may limit water and/or air infiltration between the junction of check rails 13 and 15, with water and/or air infiltration being further improved by one or more pieces of weatherstripping extending along the length of the check rails 13 and 15 above and/or below the junction between interlocking flanges 40 and 80.

In one or more embodiments, the tilt latch retainer apparatus 30 includes first and second tilt latch assemblies 20 operably attached to the top beam 33 of the tilt latch retainer apparatus 30 such that the tilt latch assemblies 20 are positioned in the tilt latch channel 68 of the check rail 15. In particular, one of the tilt latch assemblies 20 is positioned proximate a first end of the check rail 15, while a second tilt latch assembly is located proximate a second/opposite end of the check rail 15. In one or more embodiments, the tilt latch retainer apparatus 30 maintains a selected distance between the tilt latch assemblies 20 at opposite ends of the tilt latch retainer apparatus 30, e.g., along the check rail axis 11.

Each of the tilt latch assemblies 20 used in one or more embodiments of the tilt latch retainer apparatus described herein may include a latch bolt 22 movable between an engagement position and a retracted position. In the engagement position, the latch bolt 22 extends past the end of the check rail in which it is located such that it can engage a channel or other structure in a frame in which the sash is located such that the latch bolt assists in retaining the sash within the frame. In the retracted position, the latch bolt is withdrawn such that the sash is disengaged from the frame in which it is located and can be rotated or otherwise moved to provide for cleaning and/or maintenance. The specifics of latch bolt assembly construction and operation may vary and will not be further described as they are conventional assemblies. Examples of some potentially suitable tilt latch assemblies and their operation may be described herein may be described in, e.g., U.S. Pat. No. 4,791,756 (Simpson), U.S. Pat. No. 6,183,024 (Schultz et al.), U.S. Pat. No. 6,877,784 (Kelley et al.), U.S. Pat. No. 7,322,619 (Nolte et al.), U.S. Pat. No. 7,607,262 (Pettit et al.), etc.

In one or more embodiments of tilt latch retainer apparatus described herein such as the illustrative embodiment of tilt latch retainer apparatus 30, the tilt latch retainer apparatus may include an inner leg 34 connected to the top beam 33. The inner leg 34, top beam 33 and mating surface leg 32 may, in one or more embodiments, form a generally U-shaped reinforcement channel/member that defines and/or extends along a reinforcement channel axis 38. In one or more embodiments, the reinforcement channel axis 38 is aligned with, but offset from, check rail axis 11.

In the depicted illustrative embodiment, the inner leg 34 is positioned in the tilt latch channel 68 of the check rail 15 such that a reinforced portion 18 of the check rail 15 is located between the mating surface leg 32 and the inner leg 34 of the tilt latch retainer apparatus 30 (in the generally U-shaped reinforcement channel/member formed by the mating surface leg 32, inner leg 34 and top beam 33).

In particular, a first section of the inner leg 34 may be located between a first tilt latch assembly 20 and the reinforced portion 18 of the check rail 15 and a second section of the inner leg 34 may be located between the reinforced portion 18 of the check rail 15 and the tilt latch assembly 20 at the opposite end of the tilt latch retainer apparatus 30. In one or more embodiments, the inner leg 34 may extend over the entire length of the tilt latch channel 68 from the first tilt latch assembly 20 at one end of the tilt latch retainer apparatus 32 the second tilt latch assembly 20 located at the opposite end of the tilt latch retainer apparatus 30. In one or more alternative embodiments, the inner leg 34 may, however, not extend over the full length of the tilt latch retainer apparatus and may, for example, be present only where needed to secure a tilt latch assembly 20 to the tilt latch retainer apparatus 30.

In one or more embodiments of the tilt latch retainer apparatus described herein, the mating surface leg 32, top beam 33 and inner leg 34 may form a generally U-shaped reinforcement member containing the reinforced portion 18 of the check rail 15. In such embodiments, the check rail 15 may be reinforced against forces acting on the sash in a direction transverse to the reinforcement channel axis 38 and check rail axis 11. In other words, the check rail 15 may be reinforced such that it exhibits reduced deflection as a result of forces applied to the check rail 15 by, e.g., wind, object striking the outer check rail 13, etc. In particular, the top beam 33 may, by virtue of its attachment to the check rail 15 by mating surface leg 32 and inner leg 34 (regardless of whether or not inner leg 34 extends continuously between the opposite ends of the tilt latch retainer apparatus 30), reinforce the check rail 15 against wind loads and other forces acting in a similar direction on a fenestration unit incorporating the tilt latch retainer apparatus 30.

The illustrative embodiment of tilt latch retainer apparatus 30 further includes a bottom beam 35 and an innermost leg 36. The inner leg 34 and the innermost leg 36 are attached to each other across the bottom beam 35 to form a generally U-shaped tilt latch retainer channel aligned with the check rail axis 11. The tilt latch assemblies 20 are, in the illustrative embodiment, contained within that tilt latch retainer channel as formed by the inner leg 34, bottom beam 35 and innermost leg 36. In one or more embodiments, the tilt latch retainer channel formed by those components extends from one end of the check rail 15 to the opposite end of the check rail 15.

In one or more embodiments, the tilt latch retainer apparatus as described herein may, therefore, include a structure that defines two generally U-shaped channels that open in opposite directions. In particular, mating surface leg 32, top beam 33 and inner leg 34 define a reinforcement channel/member extending along a reinforcement axis 38 that opens in one direction to receive a portion of a check rail of a sash as described herein. The inner leg 34 is connected to a bottom beam 35 and an innermost leg 36 to define a tilt latch retainer channel that extends along check rail axis 11 in opens in an opposite direction from the reinforcement channel/member and which further contains the tilt latch assemblies as described herein. In one or more alternative embodiments, the tilt latch retainer apparatus 30 can be described as having an S-shaped construction because of the two generally U-shaped channels opening in opposite directions.

In one or more embodiments, the mating surface leg 32, top beam 33, inner leg 34, bottom beam 35 and innermost leg 36 may be formed as a one piece completely integral article which may be, e.g., extruded in a continuous process. Such a construction is not, however, required and the various components of the tilt latch retainer apparatus described herein may be separately formed and connected to provide the structures described herein. The mating surface leg 32, top beam 33, inner leg 34, bottom beam 35, and innermost leg 36 may be formed of one or more suitable materials such as, e.g., metals, plastics, wood, composites, etc.

Another component which may be present in one or more embodiments of the tilt latch retainer apparatus described herein is an actuator that may be used to move the latch bolts from the tilt latch assemblies between their respective engagement and retracted positions. The actuators used in tilt latch retainer apparatus as described herein may be in the form of cords, wires, straps, bars, etc. Essentially any structure capable of moving the latch bolts within the tilt latch assemblies used in a tilt latch retainer apparatus as described herein may be used as an actuator. In one or more embodiments, the actuator or actuators in the tilt latch retainer apparatus are acted on by a separate component such as a sash lock/tilt latch actuator, numerous examples of which are known in the art (see, e.g., U.S. Pat. No. 6,877,784 (Kelley et al.), U.S. Pat. No. 7,607,262 (Pettit et al.), etc.) to move the latch bolts as needed.

Referring to the illustrative embodiment of tilt latch retainer apparatus as depicted in FIGS. 5 and 6, one embodiment of a tilt latch actuator that may be used in the tilt latch retainer apparatus 30 is identified by reference numbers 24*a* and 24*b* (commonly referred to as actuator 24 herein). In particular, actuator 24*a* is attached to the tilt latch assembly 20 on the left side of tilt latch retainer apparatus 30, while actuator 24*b* is attached to the tilt latch assembly 20 on the right side of the tilt latch retainer apparatus 30. In one or more embodiments, the tilt latch actuator 24 may be described as extending in a direction aligned with the check rail axis 11.

In one or more embodiments, both actuators 24*a* and 24*b* may be portions of the same continuous actuator which may be described as a common tilt latch actuator that extends over the length of the tilt latch retainer apparatus 30 within the tilt latch retainer channel formed by inner leg 34 bottom beam 35 and innermost leg 36 as described herein. For example, the actuators 24*a* and 24*b* may be separate portions of a cord extending between the tilt latch assemblies 20. Also depicted in FIGS. 5 and 6 is an optional spool housing 70 which may, in one or more embodiments, be used to stabilize a spool having a forked end which acts on the actuator 24 located within the tilt latch retainer channel to provide tension on actuator segments 24*a* and 24*b*.

Although actuator segments 24*a* and 24*b* may be portions of a single unitary common tilt latch actuator 24, in one or more alternative embodiments separate actuators may be provided to act on each of the tilt latch assemblies 20. In such an embodiment, each of the actuator segments 24*a* and 24*b* may form a separate individual actuator attached to different tilt latch assemblies. In such an embodiment, the actuator segments may meet at a common location such as, e.g., spool housing 70.

Figure 7:
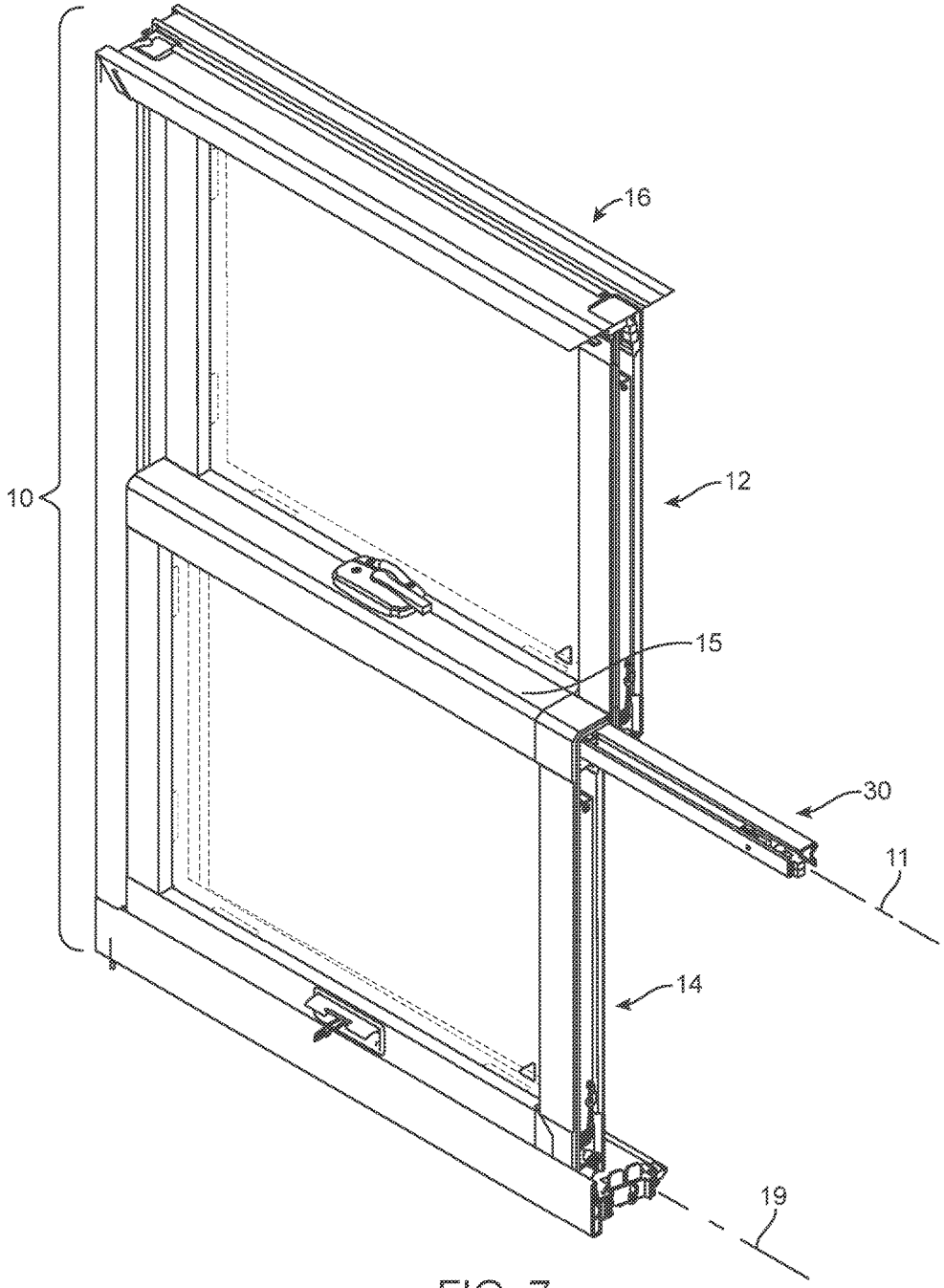
FIG. 7 depicts one illustrative method of inserting or removing one illustrative embodiment of a tilt latch retainer apparatus as described herein.

Two illustrative methods of installing the tilt latch retainer apparatus described herein can be discussed with reference to FIGS. 7 and 8. In particular, FIG. 7 depicts one illustrative method of inserting a tilt latch retainer apparatus 30 into a tilt latch channel in check rail 15 by sliding the tilt latch retainer apparatus 30 in a direction aligned with the check rail axis 11.

Figure 8:
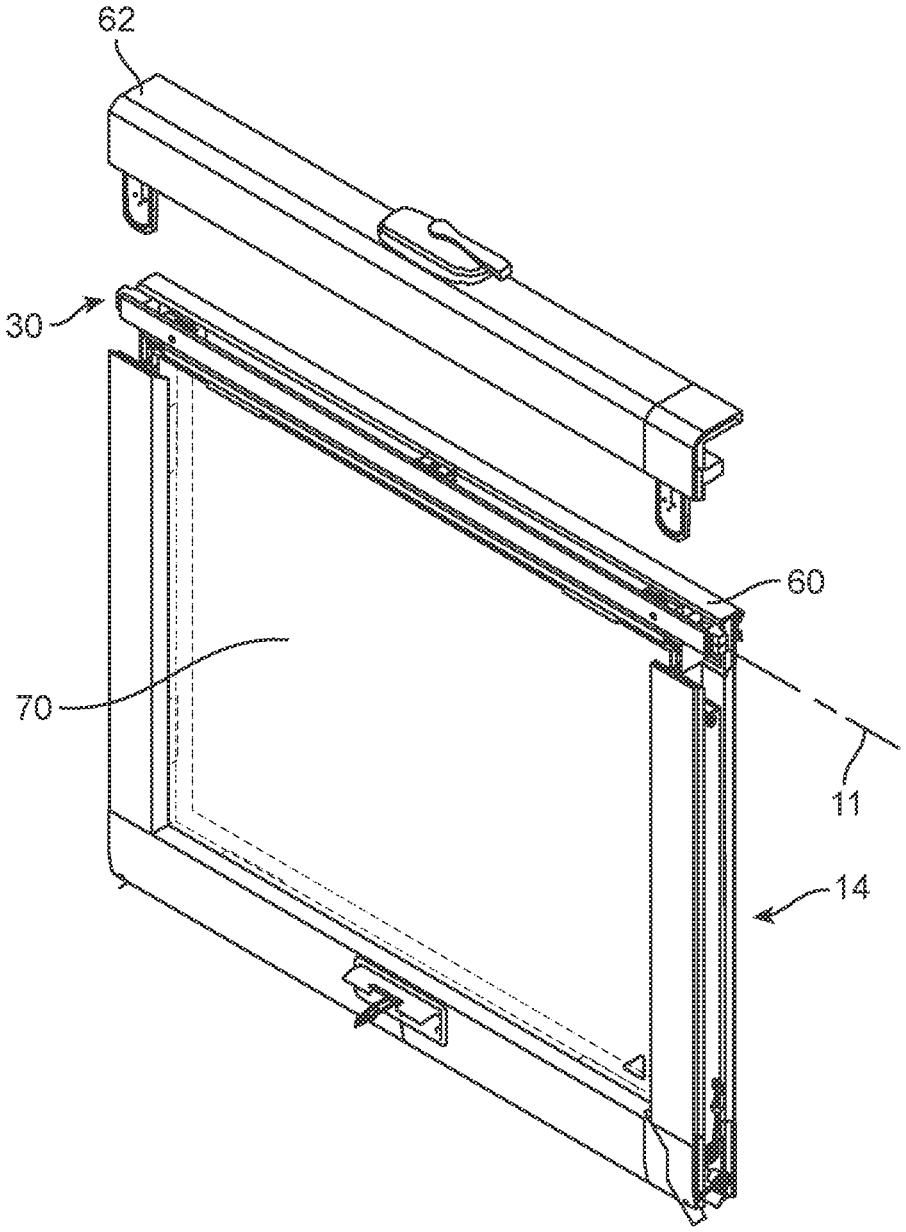
FIG. 8 depicts another illustrative method of inserting or removing one illustrative embodiment of a tilt latch retainer apparatus as described herein.

With reference to FIG. 8, one alternative illustrative embodiment of inserting a tilt latch retainer apparatus 30 into a tilt latch channel in a check rail may involve inserting the tilt latch retainer apparatus 30 in a direction transverse to the check rail axis 11. In the depicted embodiment, the check rail is constructed of two components including a base 60 and a cover 62 which is positioned over base 62 complete a check rail for the lower sash 14 (see, e.g., FIG. 3 which depicts an end view of the two components 60 and 62 of illustrative check rail 15). With the cover 62 removed from the base 60, tilt latch retainer apparatus 30 can be inserted downward into the tilt latch channel provided in base 60. That direction can be described as being transverse to the check rail axis 11.

In either of the illustrative methods described herein, the tilt latch retainer apparatus 30 is aligned in the tilt latch channel after being inserted into the tilt latch channel. With reference to the illustrative embodiments of tilt latch retainer apparatus and associated structures as depicted in FIGS. 2-5, aligning the tilt latch retainer apparatus 30 may, in one or more embodiments, position the first tilt latch assembly 20 in the tilt latch channel 68 of the check rail 15 proximate the first end of the check rail and, at the same time, the second tilt latch assembly 20 is positioned in the tilt latch channel 68 of the check rail 15 proximate the second end of the check rail. Further, the tilt latch retainer apparatus 30 maintains a selected distance between the first tilt latch assembly 20 and the second tilt latch 20 assembly along the tilt latch channel. In addition, the mating surface leg 32 is positioned on a mating surface 64 of the check rail and wherein the top beam 33 spans a portion of a width of the check rail 15 from the mating surface 64 to the tilt latch channel 68. The interlocking flange 40 is also positioned above the mating surface 64 of the check rail and is aligned with the check rail axis 11, and wherein the interlocking flange 40 defines a flange gap 44 between interlocking flange 40 and the mating surface 64 of the check rail 15.

With the tilt latch retainer apparatus 30 located and properly aligned in the tilt latch channel, the tilt latch retainer apparatus 30 may be secured in the tilt latch channel by any suitable technique or combination of techniques, e.g., mechanical fasteners, adhesives, sealants, clips, clamps, etc.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the tilt latch retainer apparatus, sashes, fenestration units and methods of using the same are discussed herein with some possible variations described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. A tilt latch retainer apparatus for a check rail of a sash, the tilt latch retainer apparatus comprising:

a reinforcement member comprising an inner leg and a mating surface leg, wherein the inner leg and the mating surface leg are connected to each other by a top beam such that the inner leg, the mating surface leg, and the top beam form a generally U-shaped reinforcement member extending from a first end of the reinforcement member to a second end of the reinforcement member along a reinforcement channel axis that extends through a reinforcement channel formed by the inner leg, the mating surface leg and the top beam, wherein the inner leg and the mating surface leg define a reinforcement channel width measured between the inner leg and the mating surface leg in a direction transverse to the channel axis, and further wherein the mating surface leg comprises a bearing surface facing the inner leg, wherein the bearing surface is configured to bear against a mating surface of a sash member on which the reinforcement member is located when the reinforcement member is installed on a check rail of a sash;

an interlocking flange located on the mating surface leg distal from the top beam, wherein the interlocking flange is oriented relative to the bearing surface such that the interlocking flange is configured to define a flange gap between interlocking flange and the mating surface of the sash member against which the bearing surface bears when the reinforcement member is installed on a check rail of a sash;

a first tilt latch assembly attached to the inner leg proximate the first end of the reinforcement member and a second tilt latch assembly attached to the inner leg of the proximate the second end of the reinforcement member, wherein the reinforcement member maintains a selected distance between the first tilt latch assembly and the second tilt latch assembly along the reinforcement channel axis.

2. An apparatus according to claim 1, wherein the flange gap comprises a depth measured from a free edge of the interlocking flange towards the top beam of the reinforcement member that is greater than a width of the flange gap measured transverse to the depth of the flange gap.

3. An apparatus according to claim 2, wherein the depth of the flange gap remains constant from a first end of the reinforcement member to the second end of the reinforcement member, and wherein the width of the flange gap remains constant from a first end of the reinforcement member to the second end of the reinforcement member.

4. An apparatus according to claim 1, wherein the apparatus further comprises a bottom beam and an innermost leg, wherein the inner leg of the reinforcement member and the innermost leg are attached to each other by the bottom beam to form a generally U-shaped tilt latch retainer channel, wherein the tilt latch retainer channel defines a tilt latch channel axis aligned with the reinforcement channel axis, and wherein the tilt latch channel extends from the first end of the reinforcement member to the second end of the reinforcement member, and further wherein the first tilt latch assembly and the second tilt latch assembly are located between the inner leg and the innermost leg in the tilt latch retainer channel.

5. An apparatus according to claim 4, wherein the reinforcement channel and the tilt latch retainer channel open in opposite directions.

6. An apparatus according to claim 4, wherein the mating surface leg, top beam, inner leg, bottom beam and innermost leg of the reinforcement member and the tilt latch retainer channel comprise a one piece, completely integral article.

7. An apparatus according to claim 1, wherein the first tilt latch assembly comprises a first latch bolt movable between an engagement position and a retracted position, wherein the first latch bolt extends past the first end of the reinforcement channel when in the engagement position, and wherein the second tilt latch assembly comprises a second latch bolt movable between an engagement position and a retracted position, wherein the second latch bolt extends past the second end of the reinforcement channel when in the engagement position.

8. An apparatus according to claim 7, further comprising a common tilt latch actuator operably connected to both the first tilt latch assembly and the second tilt latch assembly, wherein the common tilt latch actuator is configured to move the first latch bolt and the second latch bolt from their respective engagement positions to their respective retracted positions.

9. An apparatus according to claim 7, wherein the first tilt latch assembly comprises a first actuator operably connected to the first latch bolt, wherein the first tilt latch actuator is configured to move the first latch bolt from its engagement position to its retracted position, and wherein the second tilt latch assembly comprises a second actuator operably connected to the second latch bolt, wherein the second tilt latch actuator is configured to move the second latch bolt from its engagement position to its retracted position.

10. A sash apparatus comprising:

a sash comprising a frame that comprises a check rail located along one edge of the sash, wherein the check rail comprises a mating surface and a non-mating surface facing away from the mating surface, wherein the check rail receives one edge of a panel contained in the frame of the sash such that the one edge is positioned between the mating surface and the non-mating surface;

a tilt latch channel located in the check rail between the mating surface and the non-mating surface, wherein the tilt latch channel extends along a check rail axis extending between a first end of the check rail and a second end of the check rail, wherein the tilt latch channel occupies only a portion of a width of the check rail as measured between the mating surface and the non-mating surface;

a tilt latch retainer apparatus located in the tilt latch channel of the check rail, wherein the tilt latch retainer apparatus comprises a mating surface leg and a top beam attached to the mating surface leg, wherein the mating surface leg is positioned on the mating surface of the check rail and wherein the top beam spans a portion of the width of the check rail from the mating surface to the tilt latch channel, wherein the tilt latch retainer apparatus comprises:

an interlocking flange on the mating surface leg, wherein the interlocking flange is positioned on the mating surface of the check rail and is aligned with the check rail axis, and wherein the interlocking flange defines a flange gap between interlocking flange and the mating surface of the check rail;

a first tilt latch assembly operably attached to the top beam of the tilt latch retainer apparatus such that the first tilt latch assembly is positioned in the tilt latch channel of the check rail proximate the first end of the check rail; and a second tilt latch assembly operably attached to the top beam of the tilt latch retainer apparatus such that the second tilt latch assembly is positioned in the tilt latch channel of the check rail proximate the second end of the check rail;

wherein the tilt latch retainer apparatus maintains a selected distance between the first tilt latch assembly and the second tilt latch assembly along the tilt latch channel.

11. An apparatus according to claim 10, wherein the top beam extends along a length of the check rail between the first tilt latch assembly and the second tilt latch assembly.

12. An apparatus according to claim 10, wherein the mating surface leg and the top beam form an inside corner positioned over an outside corner of the check rail.

13. An apparatus according to claim 10, wherein the tilt latch channel is enclosed within the check rail except for a first opening at the first end of the check rail and a second opening at the second end of the check rail.

14. An apparatus according to claim 10, wherein the tilt latch retainer apparatus comprises an inner leg connected to the top beam and positioned in the tilt latch channel of the check rail such that a reinforced portion of the check rail is located between the mating surface leg and the inner leg, and wherein a first section of the inner leg is located between the first tilt latch assembly and the reinforced portion of the check rail, and further wherein a second section of the inner leg is located between the reinforced portion of check rail and the second tilt latch assembly.

15. An apparatus according to claim 14, wherein the inner leg extends through the tilt latch channel from the first tilt latch assembly to the second tilt latch assembly.

16. An apparatus according to claim 14, wherein the mating surface leg, the top beam, and the inner leg form a generally U-shaped reinforcement member containing the reinforced portion of the check rail.

17. An apparatus according to claim 10, wherein the flange gap comprises a depth measured from a free edge of the interlocking flange towards the top beam that is greater than a width of the flange gap measured between the free edge of the interlocking flange and the mating surface of the check rail.

18. An apparatus according to claim 17, wherein the depth of the flange gap remains constant over a length of the interlocking flange, where the length is measured in a direction aligned with the check rail axis.

19. An apparatus according to claim 17, wherein the width of the flange gap remains constant over the length of the interlocking flange.

20. An apparatus according to claim 10, wherein the tilt latch retainer apparatus further comprises a bottom beam and an innermost leg, wherein the inner leg and the innermost leg are attached to each other by the bottom beam to form a generally U-shaped tilt latch retainer channel, wherein the tilt latch retainer channel defines a tilt latch channel axis aligned with the check rail axis.

21. An apparatus according to claim 20, wherein the tilt latch retainer channel extends from the first end of the check rail to the second end of the check rail.

22. An apparatus according to claim 20, wherein the mating surface leg, top beam, inner leg, bottom beam and innermost leg comprise a one piece, completely integral article.

23. An apparatus according to claim 10, wherein the first tilt latch assembly comprises a first latch bolt movable between an engagement position and a retracted position, wherein the first latch bolt extends past the first end of the check rail when in the engagement position, and wherein the second tilt latch assembly comprises a second latch bolt movable between an engagement position and a retracted position, wherein the second latch bolt extends past the second end of the check rail when in the engagement position.

24. An apparatus according to claim 23, further comprising a common tilt latch actuator operably connected to both the first tilt latch assembly and the second tilt latch assembly, wherein the common tilt latch actuator is configured to move the first latch bolt and the second latch bolt from their respective engagement positions to their respective retracted positions.

25. An apparatus according to claim 23, wherein the first tilt latch assembly comprises a first actuator operably connected to the first latch bolt, wherein the first tilt latch actuator is configured to move the first latch bolt from its engagement position to its retracted position, and wherein the second tilt latch assembly comprises a second actuator operably connected to the second latch bolt, wherein the second tilt latch actuator is configured to move the second latch bolt from its engagement position to its retracted position.

26. An apparatus according to claim 10, wherein the sash comprises a window sash and the panel comprises a glazing panel.

27. An apparatus according to claim 26, wherein the window sash comprises a movable window sash located in a window frame containing another window sash, wherein the movable window sash is movable between an open position and a closed position in the window frame.

28. An apparatus according to claim 26, wherein the movable window sash comprises a lower sash of a double hung window unit.

* * * * *